US007363742B2

(12) United States Patent
Nerheim

(10) Patent No.: US 7,363,742 B2
(45) Date of Patent: Apr. 29, 2008

(54) SYSTEMS AND METHODS FOR ELECTRONIC WEAPONRY HAVING AUDIO AND/OR VIDEO RECORDING CAPABILITY

(75) Inventor: Magne H. Nerheim, Paradise Valley, AZ (US)

(73) Assignee: TASER International, Inc., Scottsdale, AZ (US)

( * ) Notice: Subject to any disclaimer, the term of this patent is extended or adjusted under 35 U.S.C. 154(b) by 0 days.

(21) Appl. No.: 11/270,989

(22) Filed: Nov. 12, 2005

(65) Prior Publication Data

US 2008/0010888 A1 Jan. 17, 2008

Related U.S. Application Data

(60) Provisional application No. 60/627,401, filed on Nov. 12, 2004.

(51) Int. Cl.
*F41G 1/35* (2006.01)

(52) U.S. Cl. ..... 42/146; 33/266

(58) Field of Classification Search ..... 42/146; 33/266

See application file for complete search history.

(56) References Cited

U.S. PATENT DOCUMENTS 5,026,158 A * 6/1991 Golubic ..... 356/252
5,986,695 A * 11/1999 Choi ..... 348/155
6,237,461 B1 5/2001 Poole
6,823,621 B2 * 11/2004 Gotfried ..... 42/70.06
7,088,387 B1 * 8/2006 Freeman et al. ..... 348/155
2003/0081121 A1 5/2003 Kirmuss
2003/0081127 A1 5/2003 Kirmuss
2004/0246131 A1 12/2004 Hodgkinson
2005/0002668 A1 * 1/2005 Gordon ..... 396/502
2006/0150468 A1 * 7/2006 Zhao ..... 42/119
2006/0201046 A1 * 9/2006 Gordon ..... 42/119
2007/0028501 A1 * 2/2007 Fressola et al. ..... 42/146

FOREIGN PATENT DOCUMENTS

EP 0985899 A1 3/2000

OTHER PUBLICATIONS

X26 Operator Manual, 2003, Taser International, Inc., Scottsdale, Arizona, USA.

* cited by examiner

*Primary Examiner*—Michael J Carone
*Assistant Examiner*—Stewart T Knox
(74) *Attorney, Agent, or Firm*—William R. Bachand

(57) ABSTRACT

An electronic control device includes an audio and/or video recorder, for example, packaged as a user-replaceable battery module. The audio and/or video recorder records audio and/or video information for a period beginning prior to receiving of a signal by the module. The signal may be a trigger signal, provided by the electronic control device. Use of the weapon module is documented by recorded audio and/or video information for the period, for example, extending a while before and after operation of the trigger.

15 Claims, 4 Drawing Sheets

SYSTEMS AND METHODS FOR ELECTRONIC WEAPONRY HAVING AUDIO AND/OR VIDEO RECORDING CAPABILITY

CROSS-REFERENCE TO RELATED APPLICATIONS

This application claims priority from the U.S. Provisional Patent Application Ser. No. 60/627,401 filed Nov. 12, 2004 by Magne H. Nerheim, incorporated herein by reference.

FIELD OF THE INVENTION

Embodiments of the present invention relate to weapon systems, electronic control devices, and electronic control devices having audio and/or video recording capability.

BACKGROUND OF THE INVENTION

Conventional electronic weaponry includes, for example, hand guns, batons, shields, projectiles, and area protection devices among other apparatus generally suitable for ensuring compliance with security and law enforcement. In an important application of electronic weaponry, terrorists may be stopped in assaults and prevented from completing acts involving force to gain unlawful control of facilities, equipment, operators, innocent citizens, and law enforcement personnel. In other important applications of electronic weaponry, suspects may be arrested by law enforcement officers, and the cooperation of persons in custody may be maintained by security officers. An electronic weapon generally includes a circuit that generates a stimulus signal and one or more electrodes. In operation, for example to stop a terrorist act, the electrodes may be pressed against the person to be stopped or are propelled from the electronic weaponry toward the person to be stopped or controlled. After contact or impact, a pulsing electric current is conducted between the electrodes sufficient for interfering with the person's use of his or her skeletal muscles. Interference may include involuntary, repeated, intense, muscle contractions at a rate of 5 to 20 contractions per second.

In many countries, government officers are accountable to citizens as to appropriate use of force against suspects. It is desirable to improve the data communication capability and the user interface of electronic weaponry to facilitate data gathering and data analysis. It is also desirable to facilitate collection of audio and/or video data that would help to describe and/or explain particular uses of electronic weaponry should those uses be called into question by those critical of the electronic weaponry operator's choices related to those uses.

Many forms of electronic weaponry are powered from limited electrical supplies such as batteries. Conservation of battery power results in extended use of the weaponry between required recharging of the batteries. It is desirable to use the electrical energy provided by the battery in a more efficient manner to facilitate audio and video recording.

Without systems and methods according to various aspects of the present invention, wide and effective use of audio and/or video recording in conjunction with use of electronic weaponry will not occur. Use of electronic weaponry may consequently be limited. Without electronic weaponry, injuries of law enforcement officers, civilians, suspects, and terrorists will continue with fatalities and with the loss of the opportunity to interrogate civilians, suspects, and terrorists.

SUMMARY OF THE INVENTION

An apparatus, according to various aspects of the present invention impedes locomotion by a human or animal target. The apparatus includes a high voltage pulse generator, an operator input interface, a data interface, and a processor. The high voltage pulse generator provides a current through the target via a provided electrode. The current produces contractions in skeletal muscles of the target. The operator input interface allows user specification of a duration of a period. A provided module may be coupled to the data interface. The processor receives software from the module via the data interface. The processor performs the software received via the data interface. The processor controls the generator to provide the current at a first time. The processor provides to the module via the data interface indicia of the duration of the period and indicia of the first time. A processor of the module may then identify recorded audio and/or video information for the period beginning prior to the first time. Use of the apparatus to impede locomotion by the target is documented by recorded audio and/or video information for the period.

An apparatus, according to various aspects of the present invention, produces contractions in skeletal muscles of a target to impede locomotion by the target. The apparatus is used with a provided electrode for conducting a current through the target. The apparatus includes a circuit and a module. The circuit provides the current in response to assertion of a first signal of the circuit. The current produces contractions in skeletal muscles of the target to impede locomotion by the target. The module is coupled via an interface to the circuit. The module includes a rechargeable battery and an audio and/or video recorder that records audio and/or video information for a period that begins prior to assertion of the first signal. The module provides battery power to the circuit. The interface facilitates coupling and decoupling, by an operator of the apparatus, of the module from the circuit, the module being decoupled from the circuit for at least one of recharging of the battery and receiving the information from the module.

A battery module, according to various aspects of the present invention, includes an interface, a battery, and an audio and/or video recorder. The interface facilitates attachment of a provided weapon module to the battery module for electrical coupling between the battery module and the weapon module. The battery provides current via the interface for operation of the weapon module. The audio and/or video recorder records audio and/or video information for a period beginning prior to assertion of a first signal. The battery module receives the first signal via the interface. Use of the weapon module is documented by recorded audio and/or video information for the period.

A weapon system, according to various aspects of the present invention, includes an electronic control device, a battery module, a charging base, and an electrode module. The electronic control device includes a first interface and a second interface. The battery module couples to the electronic control device via the second interface. The battery module includes a third interface. The charging base receives the battery module via the third interface for recharging a battery of the battery module. The electrode module couples to the electronic control device via the first interface for deployment of an electrode from the electrode module, and couples to the battery module via the third interface for storage of the electrode module.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
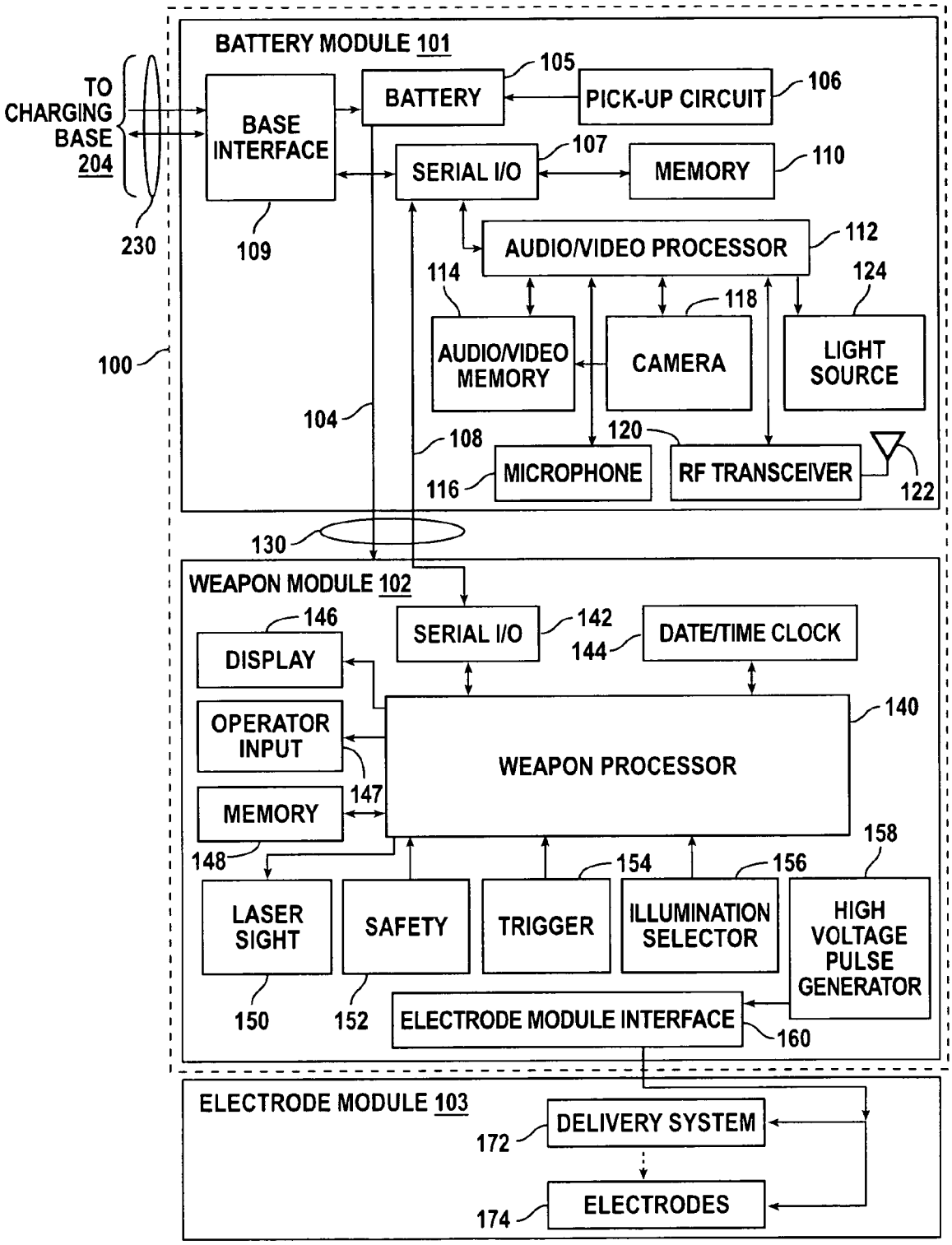
FIG. 1 is a functional block diagram of an electronic control device according to various aspects of the present invention.

An electronic control device, according to various aspects of the present invention, may include audio and/or video recording capability integral to the electronic control device. In a modular weapon system, the audio and/or video recording capability may be packaged in a module for use to expand the capabilities of a modular electronic control device that otherwise lacks one or more of audio and video recording capabilities. For example, electronic control device 100 of FIG. 1 includes battery module 101 and weapon module 102. Electronic control device 100 may be loaded with a conventional electrode module 103 (e.g., a cartridge) comprising a delivery system 172 and electrodes 174 launched by the delivery system for a single use of electronic control device 100.

A battery module, according to various aspects of the present invention, may include a video camera component for capturing images (e.g., video and/or still images) and converting the captured images into a digital format, an audio component for capturing audio information (e.g., sounds) and converting the audio information into a digital format, a memory device (e.g., a non-volatile memory such as, for example a flash memory) for storing the captured images and audio information, and a power supply such as a battery for providing power to the various components of the battery module and/or to a weapon module (e.g., an electric discharge device) coupled to the battery module. A processor may also be included in such a battery module for controlling the various components of the battery module. An interface component may also be provided in the battery module that is coupled to a portion or all of the components of the battery module (e.g., the memory, the processor, the power supply and the video camera component and/or audio component) and includes one or more interfaces adapted for coupling to one or more outside devices (such as, for example, an electric discharge device) to permit communication between the various components of the battery module and the other devices.

The interface component of a battery module may include an interface (e.g., having electrical connector contacts) suitable for coupling to a similar interface (e.g., having electrical connector contacts) in the electric discharge device that are coupled to the processor of the electric discharge device so that one or more of the video camera component, the audio component, the memory device, and the processor in the battery module are under the control of the electric discharge device's processor.

A battery module may further contain an optical light source. The light may be infrared, visible, white, or any color of light.

Figure 2:
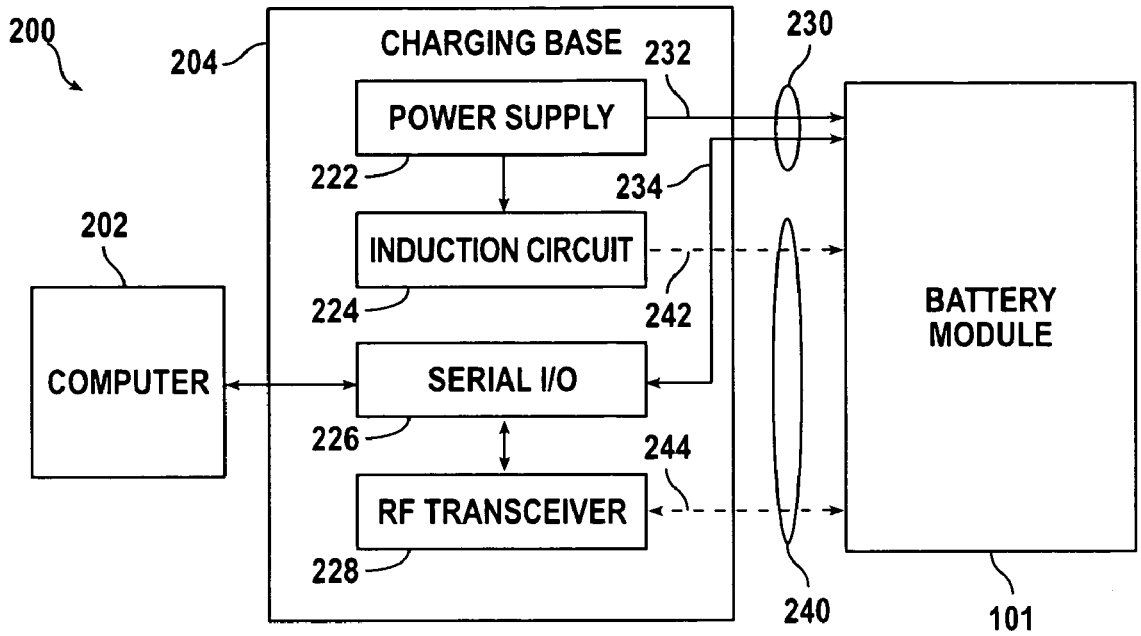
FIG. 2 is a functional block diagram of a battery module of FIG. 1 in use with a charging base according to various aspects of the present invention.
Figure 3:
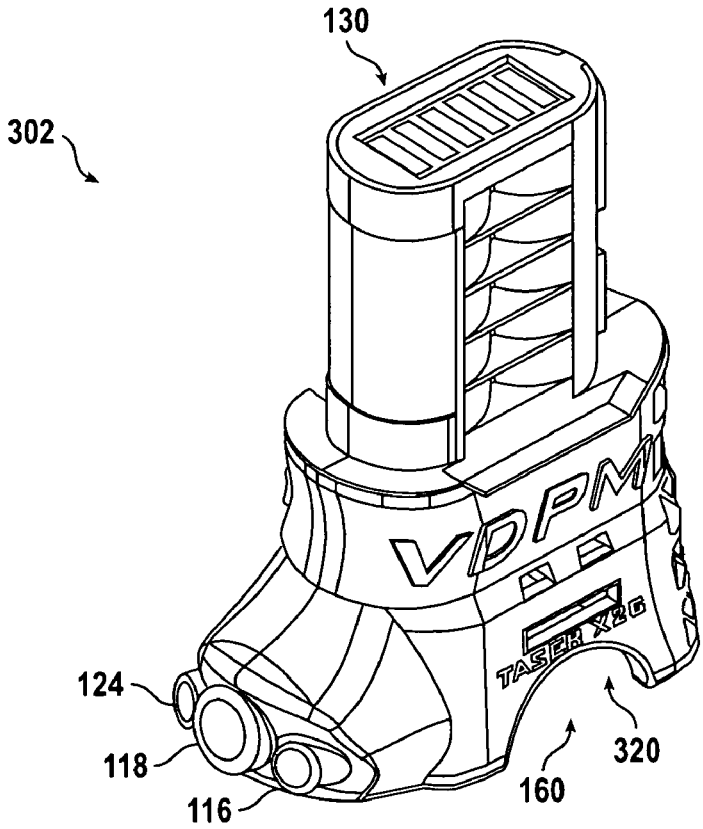
FIG. 3 is a perspective diagram of an implementation of the battery module of FIG. 1.
Figure 4:
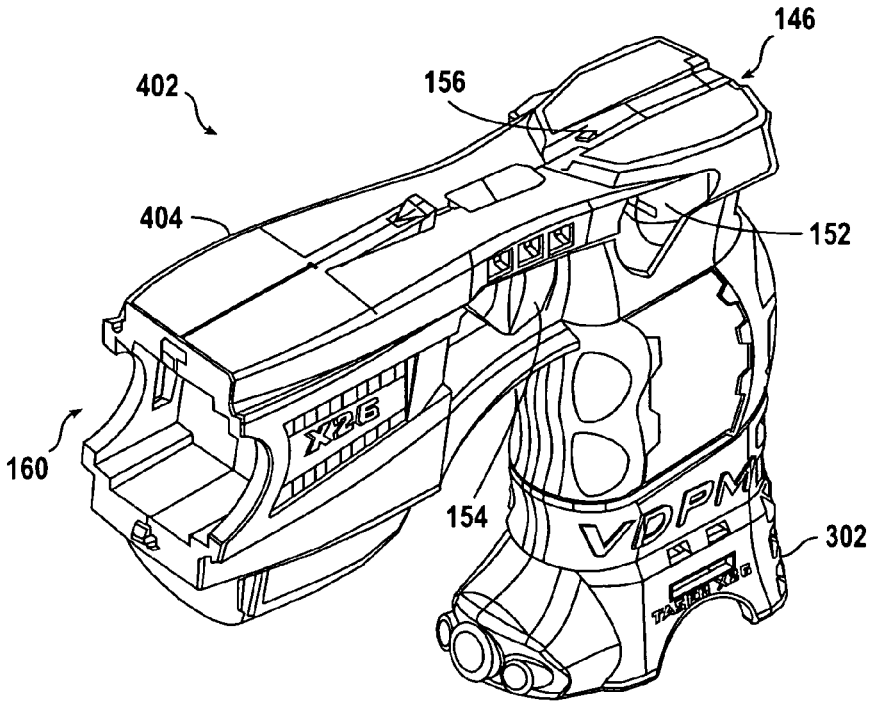
FIG. 4 is a perspective diagram of an implementation of an electronic control device of FIG. 1 without electrode module 103.

For example, battery module 101, of FIG. 1, includes base interface 109, battery 105, pick-up circuit 106, serial I/O 107, memory 110, audio/video processor 112, audio/video memory 114, microphone 116, camera 118, RF transceiver 120, antenna 122, and light source 124. Battery module 101 may be coupled to a charging base 204 of FIG. 2 for communication via signals 230 or 240. Battery module 101 may be coupled to a weapon module 102 for communication via signals 130.

A weapon module performs the functions of an electronic control device (e.g., a baton, shield, hand gun, mine, grenade, projectile, or area protection device) herein also called an electronic disabling device or an electric discharge device. For example, weapon module 102 includes weapon processor 140, serial I/O 142, date/time clock 144, display 146, memory 148, laser sight 150, safety 152, trigger 154, illumination selector 156, high voltage pulse generator 158, and electrode module interface 160.

Battery module 101 may communicate with weapon module 103 through a communication interface (e.g., a serial communication interface 107, 108, 142) that may be electrically coupled to weapon processor 140 of weapon module 102. Weapon processor 140 may be adapted for controlling various functions of electric discharge device 100. The communication interface may be utilized to tell battery module 101 (or one or more components therein) that the weapon module 102 is in an active mode (i.e., a mode in which the electric discharge device is ready to be discharged, for example, after the actuation of a trigger 154), what date and time the electric discharge device is fired (i.e., discharged), and any pertinent data that may relate to a discharge of the electric discharge device, such as, for example: date and time of firing, duration of discharge, ambient temperature (inside weapon module 102), and remaining battery capacity as a percentage.

Battery module 101 may sense (e.g., by cooperation of audio/video processor 112 of battery module 101 via serial interface 107 coupled to weapon module 102) when safety 152 of the electric discharge device is moved from an "off" position to a firing position or "on" position. After sensing a change of position of safety 152 to the firing position, battery module 101 may automatically start storing video and/or sound in audio/video memory 114.

Battery module 101 may be configured by a user via an operator input 147 of electric discharge weapon 100 to not store video and/or audio. In this case, battery module 101 functions only as a conventional DPM (e.g., as a DPM in a TASER International model X26). The storing of video and/or audio may also be configurable so that it starts by either pulling trigger 154 or pressing a selector switch (not shown) provided on the electric discharge weapon. In a preferred mode of operation, battery module 101 may start storing video and audio as soon as safety 152 of the electric discharge weapon 100 is moved to the firing position.

The audio/video memory 114 in battery module may be divided into two blocks. A first block may be used for storing video and/or audio inside a predetermined amount of time herein called a window (e.g., a plus and minus 20-second window) around a trigger event (e.g., pulling of trigger 156 that causes, for example, the discharge of the electric discharge weapon 100). A second block may be used for storing video and audio outside the window (e.g., outside the 40-second window of the first block). Both memory blocks may function in a first-in-first-out (FIFO) mode. In such a mode, the oldest events may be overwritten with more recently captured information (i.e., newer information).

Each firing event may be described by data stored in three segments: the firing data, and the two video and audio streams discussed as blocks above (e.g., one stream inside the predetermined amount of time window and the other stream outside the predetermined amount of time window). A separate data information file inside battery module 101 may be used to keep track of which segments fit together. The data information file may be utilized to tie together the firing information with the video information. In one embodiment, time stamp information (which may include date information) may be associated with each captured data segment (e.g., video segment, audio segment and firing segment) and be used to tie the firing information with the video and/or audio information. In such an implementation, the time stamp may be measured relative to the occurrence of some event, such as for example, the setting of safety 152 to a firing position, and/or the actuation of trigger 154 of the electric discharge device 100.

A memory device (not shown) may be located in a cartridge or electrode module. The armed or loaded electric discharge device (i.e., having an electrode module mounted or loaded) may be coupled to a battery module so that the information captured by the video and audio components of the battery module is stored in the memory device of the cartridge. In such a manner the information more relevant to the discharge of a particular cartridge may be stored locally in that cartridge. The data may then be accessed by removing the spent cartridge and coupling its memory device to a computer via common interfaces (not shown).

Battery module 101 may include one or more frame buffers for buffering the captured image and/or audio information from the captured data streams before they are stored in a memory suitable for downloading. Including such frame buffers in battery module 101 may provide a way for facilitating the allocating of the captured data into the two memory blocks as discussed above. For example, in one implementation, the frame buffers may be capable of storing an amount of data that can be captured by the video camera and/or audio components during an interval of time at least equal to the predetermined window of time. When a discharge of the electric discharge device occurs, the data stored in the frame buffers may then be stored in the first block of memory for data captured during the trigger window. Events occurring just before the actuation of the trigger (e.g., up to 20 seconds before) may be included in this block of memory. The use of frame buffers may also permit the rewriting over older data in a frame-by-frame manner.

Battery module 101 may include logic for compressing/processing the captured data into a compressed format (e.g., MPEG and/or MP3). All or only a portion of the captured data may be stored in the memory suitable for downloading. For example, in one such implementation, the image captured by the video camera component may be cropped so that only a region of the image is stored. This way, more relevant information may be stored in the memory while less relevant information is discarded. For example, if the electric discharge device 100 includes a laser sight 150, the captured image may be cropped so that only a region proximal to the point where the laser sight is visible in the image is stored in the memory. Audio/video processor 112 may use image analysis, pan, and zoom technologies to maintain a preferred frame contents with respect to the point where the laser sight is visible in the image stored in memory. This way image information relating to the aiming of the electric discharge device 100 toward a target is stored while portions of the captured image remote from the point on which the laser sight is targeted (i.e., information less likely to be relevant) is cropped from the image before it is stored.

The duration of the trigger window may be set (i.e., defined) by a user of electric discharge device 100 via an operator interface 147 of weapon module 102. In another implementation, the audio/video processor 112 of the electric discharge device 100 may define the duration of the trigger window. In a further implementation, the duration of the trigger window may be defined by an organization and information for setting the duration of the trigger window may be provided in memory device 110 of battery module 101 and uploaded by the processors of battery module 101 and/or electric discharge device 102 for use in controlling the operation of the video camera component 118 and/or audio component 116.

Software updates intended for weapon module 102 may be stored in battery module 101 so that the updates may be uploaded into weapon module 102 upon coupling of battery module 101 to weapon module 102. In one such implementation, configuration information for controlling the components of battery module 101 and/or weapon module 102 stored in memory 110 of battery module 101 may be custom-configured to suit the needs or rules of a particular organization (e.g., a police department of a particular city).

Battery module 302 may include a dual function interface 320. Interface 320 may be used as a cartridge holder, for example, located on the bottom of battery module 302 for storing an unloaded electrode module (e.g., an extra cartridge) for electric discharge device 100. This may help to provide a convenient way to carry an extra cartridge so that a user can quickly re-load the electric discharge device with the extra cartridge after a loaded cartridge has been discharged. A discharged cartridge is herein also called a spent cartridge.

Battery module 101 may include rechargeable batteries 105 as a power supply. To charge the batteries in one such implementation, battery module 101 may be mounted on a charging base 204 via a base interface 109. In battery module 302, the extra cartridge, discussed above, may be removed from interface 320 and battery module 302 may then be mounted at interface 320 on charging base 502 that has a mechanical interface 504 formed like a cartridge (i.e., having dimensions and a contour matching that of a cartridge).

Charging of the rechargeable battery 105 may occur through a magnetic non-contact interface. In such an implementation, electrical conductors of the charging circuit may be isolated from the outside of the battery module 101 (i.e., conductors 230 omitted). In one such implementation, charging base 204 may include an induction circuit 224 having a primary winding that is coupled to an AC power supply 222 and is also inductively coupled to a pick-up circuit 106 of battery module 101. Pick-up circuit 106 may include a secondary winding coupled to a rectifier coupled to the rechargeable battery 105 of battery module 101.

Wireless interface 244 may be based on optical or radio technology. Data downloads from battery module 101 may go through an optical interface (not shown) into charging base 204. Battery module 101 and charging base 204 may both include RF transceivers 120, 228 to permit RF communication of data and other information between battery module 101 and charging base 204. Both battery module 101 and charging base 204 may have an optical transceiver (e.g., in place of transceiver 120, 228) to accomplish data communication (e.g., IR transmitters and receivers).

A battery module may be removed from an electric discharge device and inserted top first into a charging base so that the interface 130 is coupled to the charging base. In such an embodiment, the charging base and battery module may make physical electrical contact (e.g., a conductive connection) with each other. The video and/or audio data may then be transmitted serially from battery module 101 to charging base 204.

Charging base 204 may also have a high speed serial digital interface 226 (e.g., a USB interface, a Firewire interface) that downloads the data to a computer 202 through a corresponding data cable 506. Depending on the desired battery recharging speed, the charging base may draw power either from a USB interface 506 or from an interface to AC power 508.

The power supply management in battery module 101 may follow a similar methodology as described in the discussion below regarding the use of data consumption tables in an electric discharge device. Battery module 101 may have a memory 110 (e.g., EPROM) that is accessible via an interface 107 to a microcontroller 140 of a weapon module 102. Battery tables in memory 110 may describe 105 the battery capacity, the type of battery, how much the various discharge rates are for the various components, the power consumption rates/information for the various components of battery module 101 at various operating temperatures, and various information relating to the manufacturer. As the batteries 105 in battery module 101 are being depleted, the weapon processor 140 may write this information to the memory 110 of battery module 101.

The weapon module 102 may display power consumption information on a display 146 which may be located on the back of the electric discharge device 100 as described below. The display may present the charge status of the batteries, from 99% (fully charged) to 0% (fully discharged). In such an embodiment, when battery module 101 is coupled to charging base 204, charging base 204 may read the charge status of the battery and start charging it (if it is rechargeable) while charge status information indicates that the battery 105 has a charged capacity less the 100%. When battery 105 is fully charged, the information in battery module memory 110 may be rewritten to indicate a fully charged battery. In one embodiment, power consumption information (and any other information) intended for updating power consumption information displayed by weapon module 102 may be written into the memory 110 via the same or a similar data interface provided in the charging base. This information may then be uploaded into the electric discharge device when battery module 101 is coupled to weapon module 102 via an appropriate interface 130.

Power consumption information may include prioritization information for some or all of the functions of electric discharge device 100 and/or battery module 101. The prioritization information may be utilized to limit the usage of certain elements, for example, less important elements, when the power capacity of the power supply is below a threshold level. The prioritization information may include ranking information that ranks the importance of the various components of the electric discharge device and/or battery module and may include threshold information that sets one or more power capacity thresholds for the power supply of the electric discharge device and/or battery module where at each threshold a defined range of low ranked components (i.e., for less important functions) may be disabled. In an exemplary embodiment, a threshold may be provided so that when the power supply is below a certain percentage of the total original capacity of the power supply, less important functions, (e.g., a flashlight) of electric discharge device 100 are disabled. This way power is saved for use of more important functions and components. In one implementation, highly ranked components (i.e., most important functions) may include those components of the electric discharge device, battery module, and/or DPM that are associated with the electric discharge functions used to incapacitate a target.

A tactical flashlight may be included in battery module 101. For example, light source 124 may be on/off controlled by a weapon processor 140 through an interface 130 between battery module 101 and weapon module 102. In one such implementation, when safety 152 is moved to the firing position, light source 124 is turned "on" and provides illumination toward the target. Depending on configuration, the light source may come "on" with a maximum brightness or a less than maximum brightness. If the electric discharge device 100 is configured to turn the flashlight "on" at a less than maximum brightness, then in one implementation the brightness level may be immediately changed by the user pressing illumination selector 156 (e.g., a switch provided on the electric discharge device 100). If light source 124 is "off" and safety 152 is in the firing mode, light source 124 may be immediately turned "on" via actuation of illumination selector 156.

In an embodiment where video camera component 118 is placed under the control of weapon processor 140, weapon processor 140 may also be in communication with auto-focus logic included in camera 118. This way, lighting information obtained by the auto-focus logic may be passed on to the controlling processor.

In an embodiment where the video camera component 118 is placed under the control of weapon processor 140, the weapon processor 140 may also control operation of another light source (not shown) of weapon module 102.

In one implementation, of FIGS. 3 through 7, battery module 302 may have dimensions that allow it to be mounted into a digital power magazine (DPM) slot of a weapon module 304 to form an electric discharge device 402. In other words, battery module 302 may replace a conventional DPM.

A battery module, according to various aspects of the present invention, may be implemented with interfaces for mechanical and electrical cooperation with a weapon module to form an electronic control device. The battery module, weapon module, cartridges, and a charging base may form a weapon system (e.g., as in FIGS. 3-7) having particular synergies as a result of the use of mechanical and electrical interfaces common among the modules. For example, battery module 302 of FIG. 3 may include all of the structures and functions of battery module 101 discussed herein. Battery module 302 includes interface 130, comprising an electrical connector having six butt contacts; a dual purpose interface 320; a light source 124, a camera 118, and a microphone 116. Dual purpose interface 320 is compatible with interface 160 to receive and store an electrode module 103; and is compatible with a base interface 109 to accept a current from a charging base for recharging a battery 105 of the battery module.

Electronic control device 402 (of FIG. 4) is of the hand-held type for local and remote stun functions. Device 402 includes weapon module 404 coupled to battery module 302. Weapon module 404 may include all of the structures and functions of weapon module 102 discussed above. Weapon module 404 has an electrode module interface 160 (shown prior to loading an electrode module or cartridge) that receives one cartridge. Weapon module 404 further includes a safety 152, a trigger 154, and a display 146 visible from the rear of weapon module 404.

In one implementation, weapon module 404 is of the type known as a model X26 marketed by TASER International. Because the battery module can supply replacement and/or amended software for use by the weapon processor 140 of weapon module 404, and because communication between weapon module 404 and battery module 302 is implemented as additional serial communication via the serial communication capability of the model X26, existing model X26 electronic control devices may be easily retrofitted in the field to add audio and/or video recording. For example, a conventional battery module (e.g., a digital power magazine (DPM)) for the model X26 may be replaced with battery module 302.

Figure 5:
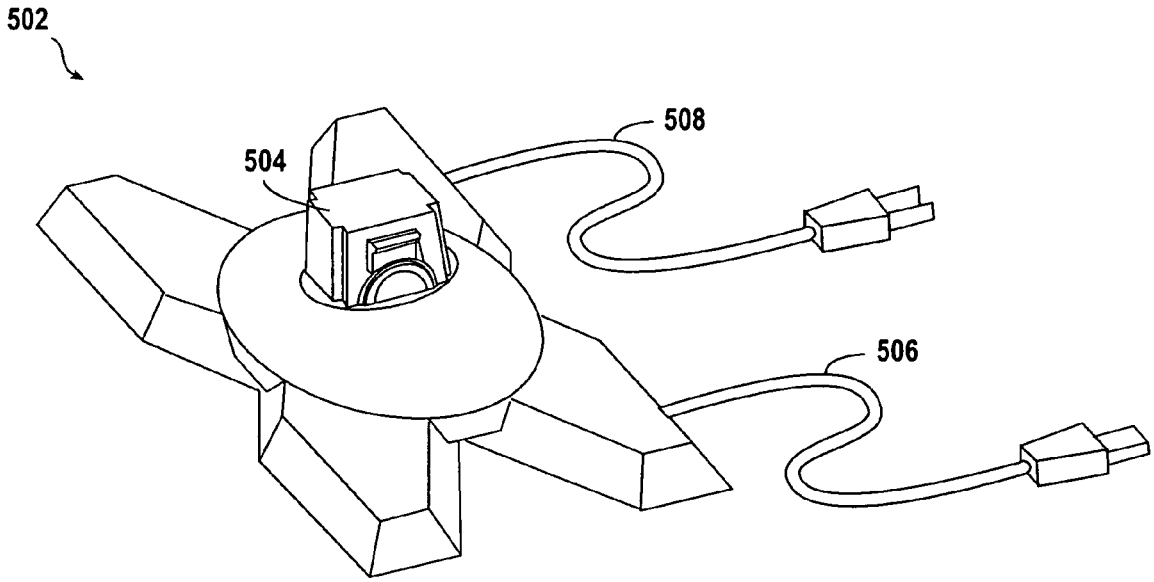
FIG. 5 is a perspective diagram of an implementation of the charging base of FIG. 2.

Charging base 502 (of FIG. 5) may include all of the structures and functions of charging base 204, discussed above. Base 502 provides an interface 504 compatible with an electrode module interface of a battery module. For providing energy to the charging base to recharge a battery of the battery module, household AC power may be supplied to the charging base via conventional cable 508 or DC power may be supplied to the charging base via conventional USB cable 506. Cable 506 couples base 502 to a computer 202. Interface 504 includes a physical/mechanical structure shaped like a cartridge and having the equivalent of the conventional fasteners used by a cartridge to couple the cartridge to a weapon module. Equivalent fasteners are used in interface 504 to support and couple a battery module to the base. As shown in FIG. 5, interface 504 of base 502 may have no exposed electrical conductors. Interface 504 as shown illustrates an implementation where signals 240 are used in place of signals 230, as discussed above.

Figure 6:
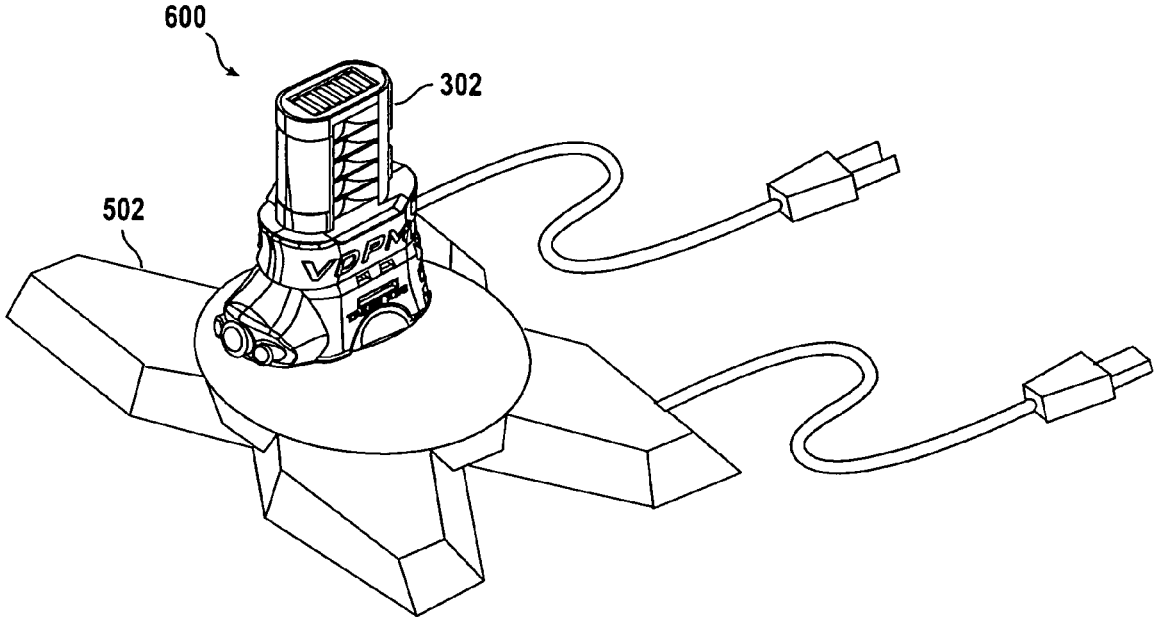
FIG. 6 is a perspective diagram of the battery module of FIG. 3 mounted on the charging base of FIG. 5.

For example, assembly 600 of FIG. 6 includes base 502 supporting and electrically communicating with battery module 302. Communication via interface 504 to battery module 302 may include transfer of recorded audio/video information and transfer of software for performance by weapon processor 140 as discussed above. Communication may further include recharging one or more batteries 105 of battery module 302.

Figure 7:
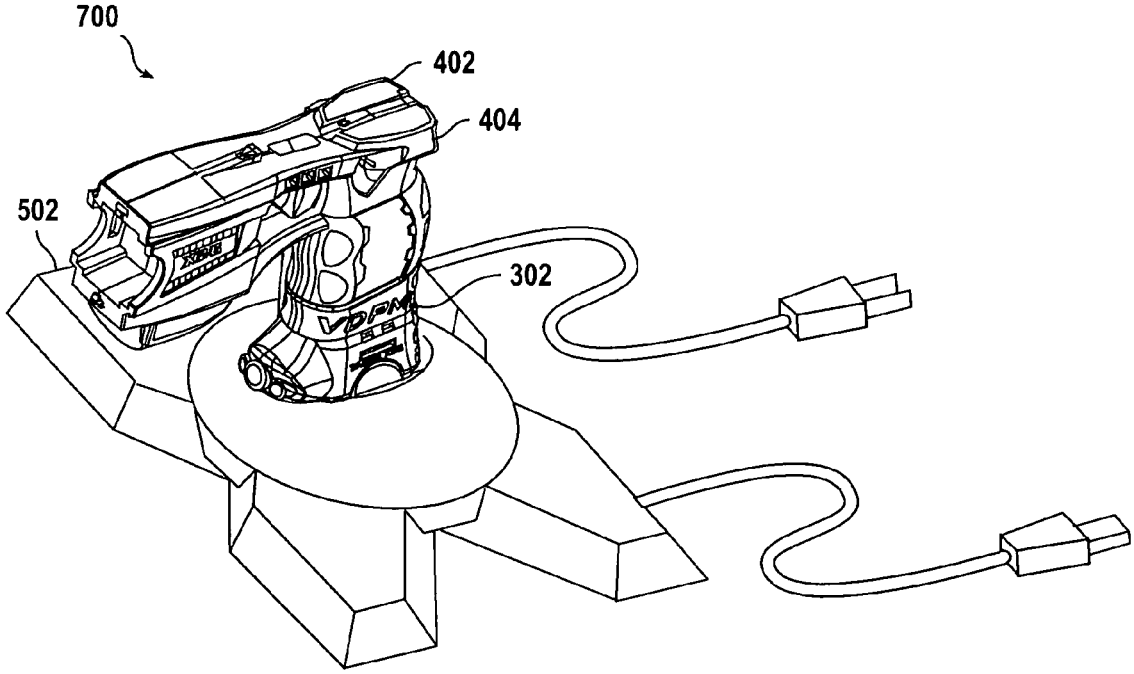
FIG. 7 is a perspective diagram of the electronic control device of FIG. 4 mounted on the charging base of FIG. 5.

As another example, assembly 700 of FIG. 7 includes base 502 supporting electronic control device 402. Because battery module 302 has a first interface to a weapon module separated with sufficient mechanical clearances from a second interface to a charging base, an electronic control device 402 may be coupled to base 502 without removal of battery module 302 from weapon module 404 of device 402.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A module for any one electronic control device of a plurality of electronic control devices, the electronic control device operative with a cartridge, the cartridge having wire-tethered electrodes for launching from the cartridge generally in a direction of aiming to impact a human or animal target, the module comprising:

a. a case;

b. a battery within the case;

c. a recording video camera within the case for recording video in the direction of aiming;

d. an electrical interface through the case for a first signal and a second signal; and e. a mechanical interface that secures the case to the electronic control device for operation of the electrical interface, that facilitates separation of the case from the electronic control device for field-interchangeable use of the module in turn with another electronic control device of the plurality of electronic control devices, and that orients the video camera in the direction of aiming; wherein f. the battery powers the recording video camera, and powers, via the first signal through the case, the electronic control device to provide a current through the target via the electrodes; and g. the recording video camera begins recording video in response to the second signal through the case from the electronic control device.

2. A battery module for any one weapon module of a plurality of weapon modules, the weapon module operative with an electrode module, the electrode module having, electrodes for launching generally in a direction of aiming to impact a human or animal target, the weapon module having a circuit that generates a relatively high voltage pulse for pulsed current through the electrodes and through the target, the battery module comprising:

a. a case;

b. a battery within the case;

c. a recorder within the case for recording audio and/or video in the direction of aiming;

d. an electrical interface through the case for a first signal and a second signal; and e. a mechanical interface that secures the case to the weapon module for operation of the electrical interface, that facilitates separation of the case from the weapon module for field-interchangeable use of the battery module in turn with another weapon module of the plurality of weapon modules, and that orients the recorder in the direction of aiming; wherein f. the battery powers the recorder, and powers, at a relatively low voltage via the first signal through the case, the circuit to provide the relatively high voltage pulse of current through the target via the electrodes; and g. the recorder begins recording in response to the second signal through the case from the weapon module.

3. The battery module of claim 2 wherein the recorder further records time and/or date in association with the audio and/or video.

4. The battery module of claim 3 wherein the second signal further conveys indicia of time and/or date.

5. The battery module of claim 2 further comprising a light source powered by the battery for illuminating the target in response to the second signal.

6. The battery module of claim 2 wherein the second signal conveys in serial commands and data.

7. The battery module of claim 2 wherein the second signal conveys indicia of a trigger event of the weapon module and the recorder records audio and/or video for a period prior to the trigger event.

8. The battery module of claim 2 further comprising a holder that accepts a second electrode module for storage.

9. The battery module of claim 8 wherein the holder further accepts a charger for recharging the battery.

10. The battery module of claim 9 wherein the holder comprises a communication interface for exchanging commands and data to and from the battery module.

11. The battery module of claim 2 further comprising an RF transmitter that transmits recorded audio and/or video information.

12. The battery module of claim 2 wherein the recorder comprises a camera that captures video to be recorded by the recorder.

13. The battery module of claim 12 wherein the recorder further comprises a processor that crops captured video prior to recording by the recorder.

14. The battery module of claim 13 wherein the processor determines a position of a laser illumination in the captured video and crops the captured video in accordance with the position.

15. The battery module of claim 2 wherein the recorder comprises a microphone that captures sound to be recorded by the recorder.

* * * * *

UNITED STATES PATENT AND TRADEMARK OFFICE

CERTIFICATE OF CORRECTION

PATENT NO. : 7,363,742 B2
APPLICATION NO. : 11/270989
DATED : April 29, 2008
INVENTOR(S) : Magne H. Nerheim It is certified that error appears in the above-identified patent and that said Letters Patent is hereby corrected as shown below:

In column 10, line 34, in Claim 2, delete "having," and insert -- having --, therefor.

Signed and Sealed this
Fourth Day of October, 2011

David J. Kappos

David J. Kappos
*Director of the United States Patent and Trademark Office*